US006024678A

United States Patent [19]

Solomon

[11] Patent Number: 6,024,678

[45] Date of Patent: Feb. 15, 2000

[54] VACUUM CLEANER LEG EXERCISE DEVICE

[76] Inventor: Guillermo Solomon, P.O. Box 310, Santiago, Wis.

[21] Appl. No.: 09/263,539

[22] Filed: Mar. 8, 1999

[51] Int. Cl.[7] ..... A63B 21/008

[52] U.S. Cl. ..... 482/111; 482/2; 482/79; 482/80; 482/112; 482/148; 134/21; 15/340.2

[58] Field of Search ..... 482/148, 111, 482/112, 80, 79, 2; 134/21; 169/30, 34; 248/205.15, 309.3; 15/340.2

[56] References Cited

U.S. PATENT DOCUMENTS 4,204,675 5/1980 McGinnis .
5,267,923 12/1993 Piaget .
5,441,466 8/1995 Piaget .

FOREIGN PATENT DOCUMENTS 117698A 9/1984 European Pat. Off. ..... 482/123
2114901 9/1983 United Kingdom ..... 482/4

*Primary Examiner*—Richard J. Apley
*Assistant Examiner*—Lori Baker
*Attorney, Agent, or Firm*—Charles E. Baxley, Esq.

[57] ABSTRACT

A device for vacuuming, which is powered by the leg exercise motion of a user, includes a pair of bellows units which are mounted on the user's feet and a tank which is mounted on the user's back. A hand-held cleaning wand is connected to the tank by a flexible hose. The user alternately compresses and releases the bellows units, overcoming an internally mounted spring, and as the bellows unit returns to its original shape, a partial vacuum is formed therein. The bellows units are connected to the tank by flexible tubes and the partial vacuum draws air into the cleaning wand, thereby vacuuming dirt and debris into the tank.

7 Claims, 2 Drawing Sheets

VACUUM CLEANER LEG EXERCISE DEVICE

BACKGROUND OF THE INVENTION

1. Field of the Invention

The present invention relates generally to the field of exercise equipment and more particularly to a vacuum cleaner leg exercise device.

2. Prior Art

The prior art related to pneumatically operated exercise devices includes the following U.S. Patents.

U.S. Pat. No. 4,204,675 to McGinnis shows a pair of foot treadles which are hinged at one end and which are normally held in an inclined position, relative to a base, by springs. Mounted between each treadle and the base is a normally inflated flexible air chamber. The air chamber communicates with a valve which provides a flow resistance thereby resulting in an effort being required to expel air from the air chamber.

U.S. Pat. No. 5,267,923 to Piaget et al shows a foot treadle exercising apparatus which has a pair of foot treadles and which provides for transfer of air from one foot treadle to another through a restricted pathway which has an adjustable valve. The valve enables a user to select a desired work load.

U.S. Pat. No. 5,441,466 to Piaget et al. shows a rectangular exercise stepping platform which is supported by four leg bellows.

Despite the various devices in the prior art there remains a need for a leg exercise device in which the work of exercising is transformed into a useful function, such as vacuuming.

OBJECTS AND SUMMARY OF THE INVENTION

It is therefore an object of the present invention to provide a vacuum cleaner leg exercise device which allows a user to vacuum dirt and debris into a tank as a result of leg exercise motions.

Another object of the present invention is to provide a vacuum cleaner leg exercise device which does not require a motor of any kind.

Another object of the present invention is to provide a vacuum cleaner leg exercise device which does not require electricity.

Another object of the present invention is to provide a vacuum cleaner leg exercise device which enables an operator to engage in leg exercises while vacuuming.

Another object of the present invention is to provide a vacuum cleaner leg exercise device which is nearly silent during operation.

Yet another object of the present invention is to provide a vacuum cleaner leg exercise device which utilizes a relatively small number of components which can be manufactured economically thereby resulting in a relatively low overall cost.

The foregoing and other objects and advantages of the present invention will appear more clearly hereinafter.

In accordance with the present invention there is provided a vacuum cleaner leg exercise device which includes a pair of bellows units, a tank and a cleaning wand. Flexible tubes connect the tank and each of the bellows units and also connect the tank and the cleaning wand. The bellows units include shoes for attachment to a user's legs and one-way air valves which allow air to flow out of a bellows unit when the bellows unit is compressed by the user's weight. A helical spring restores the original volume of the bellows unit when the user's weight is removed and the one-way valve allows air to refill the partial vacuum which is created in the expanding bellows. The air which refills the expanding bellows flows through the cleaning wand and through a filter bag which is mounted in the tank unit.

The user, as a result of leg exercise motion, creates a flow of air which enters the cleaning wand and enables the user to suck dirt and debris into the filter bag.

BRIEF DESCRIPTION OF THE DRAWINGS

Other important objects and advantages of the present invention will be apparent from the following detailed description taken in connection with the accompanying drawings wherein like numerals refer to like parts and in which.

DETAILED DESCRIPTION OF THE INVENTION

Figure 1:
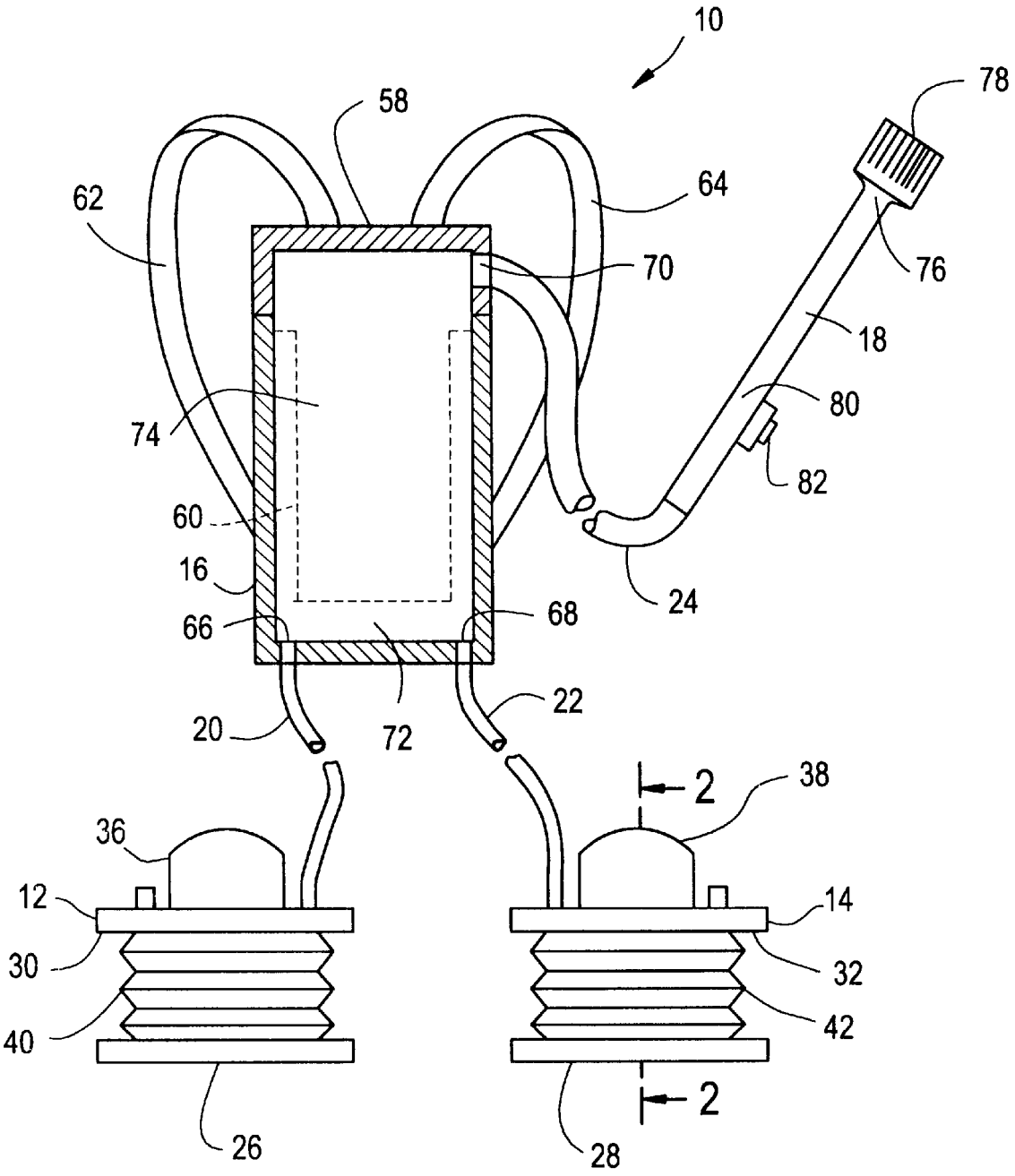
FIG. 1 is an overall elevational view of a vacuum cleaner leg exercise device, partially in section, made according to the present invention.
Figure 2:
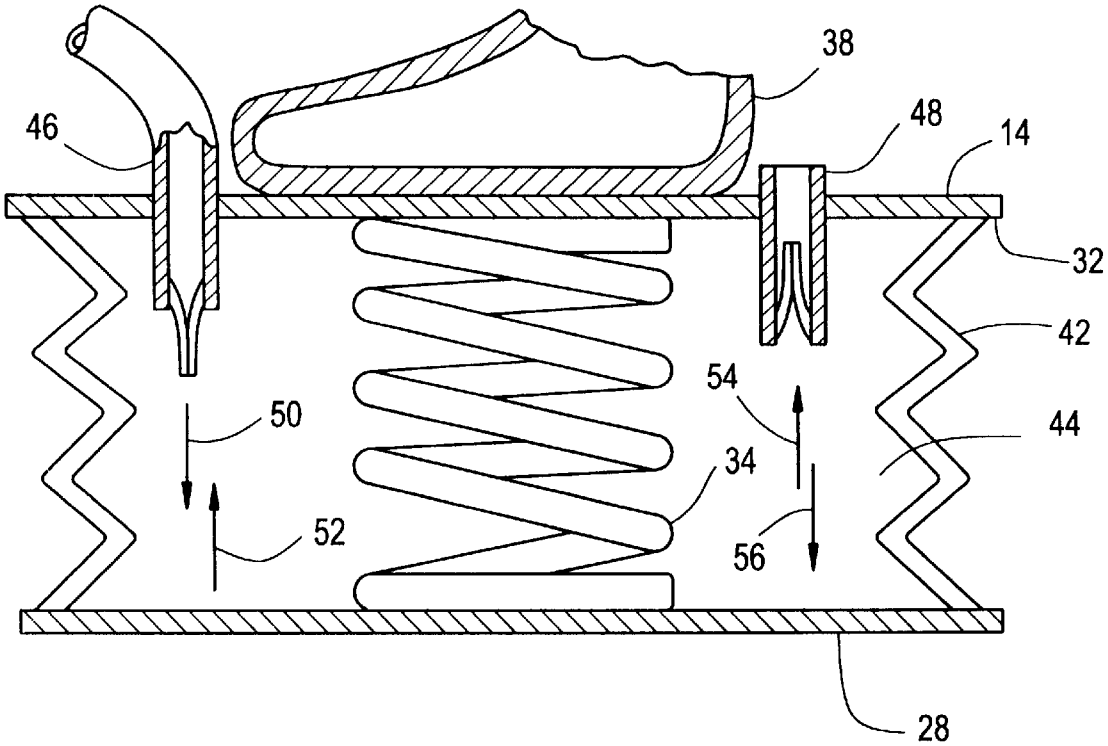
FIG. 2 is a cross-sectional view, taken along line 2—2 of FIG. 1, showing the internal construction of the bellows unit.

Referring to the drawings, wherein like reference numbers designate like or corresponding parts throughout, there is shown in FIGS. 1–2 a vacuum cleaner leg exercise device 10 made in accordance with the present invention.

The vacuum cleaner leg exercise device 10 includes a pair of bellows units 12, 14, a tank unit 16, and a cleaning wand 18. Flexible tubes 20, 22 connect the bellows units 12, 14 and the tank unit 16 and tube 24 connects the tank unit 16 and the cleaning wand 18.

As is shown in FIG. 2, each of the bellows units 12, 14 includes a sole member 26, 28, an upper platform 30, 32 and a spring 34 which is mounted on the sole members 26, 28 and which supports the upper platforms 30, 32. A shoe 36, 38 is attached to the upper platforms 30, 32.

Flexible bellows 40, 42 connect the sole members 26, 28 and the upper platforms 30, 32 and defines an internal volume designated by the reference numeral 44. The upper platforms 30, 32 each include a pair of one-way valves 46, 48. Valve 46 allows air to flow in the direction shown by arrow 50 and prevents air flow in the opposite direction, as shown by arrow 52. Valve 48 allows air to flow in the direction shown by arrow 54 and prevents air flow in the opposite direction, as shown by arrow 56.

Tank unit 16 includes a cover 58, internally mounted filter bag 60, shoulder straps 62, 64 and ports 66, 68, 70 for connection of flexible tubes 20, 22, 24. Flexible tubes 20, 22, communicating with valves 46, 48 on the upper platforms 30, 32 of the bellows units 12, 14, are attached to the ports 66, 68 on the tank unit 16 and communicate with the lower volume below the filter bag 60 which is designated by the reference numeral 72. Flexible tube 24 is connected to port 70 and communicates with the upper volume defined by the filter bag 60 which is designated by the reference numeral 74 and also communicates with the hollow cleaning wand 18.

The end 76 of the cleaning wand 18 has a flexible portion 78 which may be in the nature of a feather duster or a soft rubber member which assists in sweeping dust and debris into the cleaning wand 18. An intermediate portion 80 of the cleaning wand 18 includes an air control valve 82 which may be used to control the degree of suction of the device 10.

During use an operator secures the tank 16 on his or her back and places his or her feet into the shoes 36, 38 on the upper platforms 30, 32 of the bellows units 12, 14. As the operator places his or her weight on bellows units 12, 14, the spring 34 is compressed and the internal volume 44 of the bellows unit 12, 14 is reduced. The air in the bellows unit 12, 14 is pushed out of the bellows 42 through the one-way valve 48. When the operator's weight is removed from bellows units 12, 14, the helical spring 34 restores the bellows unit 42 to its original size thereby creating a reduction in the air pressure or partial vacuum in the bellows 42. As a result, air from the atmosphere rushes through the cleaning wand 18, through the upper volume 74, through the filter bag 60, through the lower volume 72, through the tubes 20, 22 and finally through the one-way valve 46 to fill the bellows 40, 42.

By alternately placing his or her weight on bellows units 12, 14, the operator causes air to flow into the end 76 of the cleaning wand 18, thereby enabling the cleaning wand 18 to vacuum dirt and debris which are trapped in the filter bag 60.

The operator can thus combine the act of vacuuming with leg exercise such as walking or other rhythmic leg motions which alternately compress and release each of the bellows units 12, 14.

The foregoing specific embodiment of the present invention as set forth in the specification herein is for illustrative purposes only. Various deviations and modifications can be made within the spirit and scope of this invention, without departing from the main theme thereof.

I claim:

1. A vacuum cleaner leg exercise device comprising:

a tank;

a filter bag, with said filter bag disposed in said tank and disposed dividing said tank into a first chamber and a second chamber;

a hollow cleaning wand, with said cleaning wand having a first end and a second end;

first flexible tube means connecting said first chamber and said first end of said cleaning wand;

a pair of bellows units, with each of said bellows units comprising:

an upper plate;

a lower plate;

a spring disposed between said upper plate and said lower plate;

a flexible bellows connecting said upper and said lower plates;

a first one-way valve disposed to permit air flow out of said bellows unit and to prevent air flow in the reverse direction;

a second one-way valve disposed to permit air flow into said bellows unit and to prevent air flow in the reverse direction; and a flexible tube connecting said second one-way valve and said second chamber of said tank, whereby compression and subsequent release of a bellows unit causes the formation of a partial vacuum therein and causes air to flow through the cleaning wand into the tank and into the bellows unit.

2. The vacuum cleaner leg exercise device as claimed in claim 1, further comprising:

a pair of shoes mounted, one each, on said upper plates of said bellows units.

3. The vacuum cleaner leg exercise device as claimed in claim 1, wherein said spring comprises a helical spring.

4. The vacuum cleaner leg exercise device as claimed in claim 1, further comprising:

a pair of shoulder straps mounted on said tank.

5. The vacuum cleaner leg exercise device as claimed in claim 1, further comprising:

a flexible tip mounted on said second end of said hollow cleaning wand.

6. The vacuum cleaner leg exercise device as claimed in claim 1, wherein said lower plate comprises a sole plate.

7. The vacuum cleaner leg exercise device as claimed in claim 1, wherein said cleaning wand further comprises an air control valve.

* * * * *